United States Patent [19]

Yancey, Jr. et al.

[11] Patent Number: 4,585,545

[45] Date of Patent: Apr. 29, 1986

[54] PROCESS FOR THE PRODUCTION OF AROMATIC FUEL

[75] Inventors: Robert E. Yancey, Jr., Ashland; William P. Hettinger, Jr., Russell, both of Ky.

[73] Assignee: Ashland Oil, Inc., Ashland, Ky.

[21] Appl. No.: 679,172

[22] Filed: Dec. 7, 1984

[51] Int. Cl.[4] ..... C10G 55/06; C10G 57/00

[52] U.S. Cl. ..... 208/74; 208/56; 208/68

[58] Field of Search ..... 208/74, 67, 68, 75, 208/72, 73, 56 CT, 85, 95

[56] References Cited

U.S. PATENT DOCUMENTS

| | | | |
|---|---|---|---|
| 2,772,214 | 11/1956 | Langer, Jr. | 208/74 |
| 3,008,895 | 11/1961 | Hansford et al. | 208/68 |
| 3,050,457 | 8/1962 | Wilson | 208/67 |
| 3,182,011 | 5/1965 | Friedman | 208/74 |
| 3,201,341 | 8/1965 | Anderson et al. | 208/74 |
| 3,287,254 | 11/1966 | Paterson | 208/68 |
| 3,623,973 | 11/1971 | Tarhan | 208/60 |
| 3,691,058 | 4/1970 | Hamner et al. | 208/73 |
| 3,755,141 | 8/1973 | Youngblood | 208/67 |
| 3,869,378 | 3/1975 | Pollock et al. | 208/56 |
| 3,894,933 | 7/1975 | Owen et al. | 208/74 |
| 3,964,876 | 6/1976 | James | 208/75 |
| 4,022,681 | 5/1977 | Sheng et al. | 208/57 |
| 4,388,175 | 6/1983 | Lionetti et al. | 208/77 |
| 4,417,974 | 11/1983 | Haunschild | 208/75 |
| 4,426,276 | 1/1984 | Dean et al. | 208/68 |

*Primary Examiner*—John Doll
*Assistant Examiner*—Anthony McFarlane
*Attorney, Agent, or Firm*—Richard C. Willson, Jr.; C. William Crady

[57] ABSTRACT

An aromatic gasoline component is prepared in a multi-step petroleum refining process starting with a heavy carbometallic petroleum fraction which is catalytically cracked to yield a light catalytic cycle oil which, in turn, is mildly hydrogenated to produce a partially saturated bicyclic hydrocarbon fraction which itself is catalytically cracked to yield a monoaromatic hydrocarbon fraction from which is recovered a gasoline product. The bicyclic hydrocarbons are converted to monoaromatics by selective partial saturation and ring scission.

10 Claims, 1 Drawing Figure

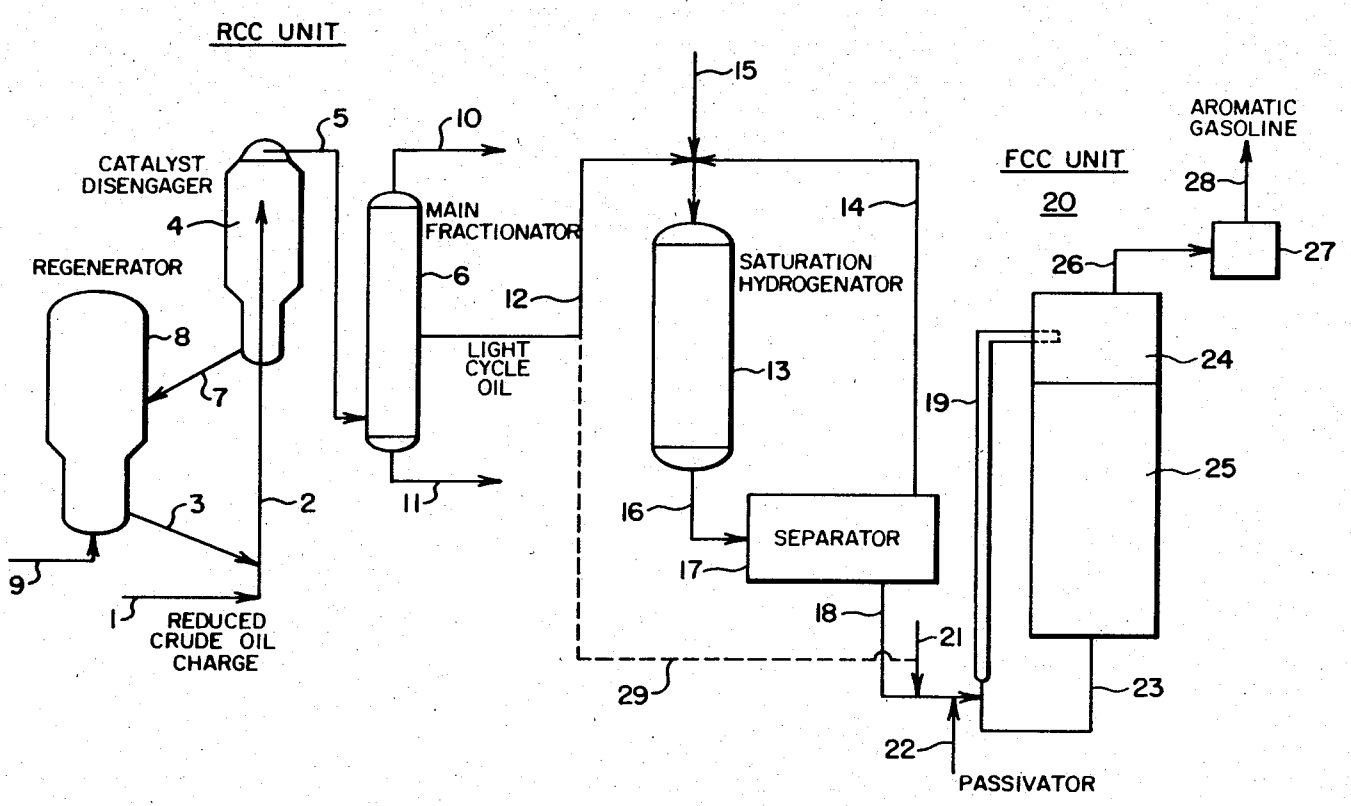
RCC UNIT
CATALYST DISENGAGER
REGENERATOR
REDUCED CRUDE OIL CHARGE
MAIN FRACTIONATOR
LIGHT CYCLE OIL
SATURATION HYDROGENATOR
SEPARATOR
FCC UNIT
20
AROMATIC GASOLINE
PASSIVATOR
1
2
3
4
5
6
7
8
9
10
11
12
13
14
15
16
17
18
19
21
22
23
24
25
26
27
28
29

PROCESS FOR THE PRODUCTION OF AROMATIC FUEL

BACKGROUND OF THE INVENTION

This invention relates to a a multistep process for the production of a gasoline boiling range fuel component comprising monoaromatic hydrocarbons. More specifically the process of the invention comprises a process for upgrading a low value fraction from the cracking of carbometallic residual hydrocarbon oil to high octane gasoline.

Ashland Oil, Inc.'s new heavy oil conversion process (RCC SM Process) has been described in the literature (Oil and Gas Journal, Mar. 22, 1982, pages 82–91), NPRA paper. AM-84-50 (1984 San Antonio) and in numerous U.S. patents assigned to Ashland Oil, Inc., for example U.S. Pat. No. 4,341,624 issued July 27, 1982 and U.S. Pat. No. 4,332,673 issued June 1, 1982. These disclosures are incorporated by reference in the present disclosure.

Briefly, the RCC Process is designed to crack heavy residual petroleum oils that are contaminated with metals such as vanadium and nickel. The feedstock to the until will have an initial boiling point above about 343° C. (650° F.), an API gravity of 15–25 degrees, a Conradson carbon above about 1.0, and a metals content of at least about 4 parts per million (PPM). The hot feed is contacted with fluid cracking catalyst in a progressive flow type elongated riser cracking tube and the cracked effluent is recovered and separated.

One of the fractions recovered from the main fractionator is a light cycle oil (LCO) boiling in the range of from about 216° C. (430° F.) to about 332° C. (630° F.). This fraction is not suitable as a motor fuel component because it contains a high proportion 10–60 vol. %, more typically 20–40 vol% of dual ring (bicyclic) aromatic hydrocarbons i.e. naphthalene and methyl and ethyl naphthalenes.

Because of the refractory nature of the LCO it cannot be recycled for further cracking in the RCC Process, nor can it be converted in a conventional fluid catalytic cracking (FCC) unit.

The object of this invention is to provide a process for upgrading the LCO fraction to a high octane aromatic gasoline component.

SUMMARY OF THE INVENTION

The process of the invention comprises the sequential steps of catalytic cracking of carbometallic heavy oil in a reduced crude cracking unit, recovering a hydrocarbon fraction comprising bicyclic (two ring) aromatic hydrocarbons from the cracked effluent, contacting said fractions with hydrogen and a catalyst to preferentially saturate one of the two aromatic rings of the bicyclic aromatic hydrocarbons in said fraction and subjecting said hydrogenated bicyclic fraction to fluid catalytic cracking (FCC) to produce a gasoline product comprising monoaromatic (one ring) hydrocarbons.

When the hydrocarbon feed to the fluid catalytic cracking step contains metal compounds such as vanadium and nickel the cracking is preferably carried out in the presence of a metals passivation agent such as an antimony compound, a tin compound or a mixture of antimony and tin compounds.

BRIEF DESCRIPTION OF THE DRAWING

The drawing is a schematic representation of a preferred mode of the multistep process of the invention.

DETAILED DESCRIPTION

The reduced crude cracking unit (RCCU) employed for the first step of the process of this invention converts a carbometallic hydrocarbon oil feed to a product slate comprising about 45–55 vol. % gasoline, about 16–24 vol. % $C_4$ minus, about 10–20 vol. % heavy cycle oil and coke and about 15 to 25 vol. % light cycle oil. This latter material contains the dual ring aromatic hydrocarbons to be further treated in the subsequent process steps.

Typical RCC feedstock characteristics and product yields are set forth below in Table 1. This fraction is high sulfur 650+° F. untreated reduced crude oil. Preferably 70 vol.% of the feed boils above 343° C. (650° F.), the Con Carbonis > 1.0 WT% and the metals content of the feed is at least 4 ppm nickel equivalents by WT.

TABLE 1

| | |
|---|---|
| FEEDSTOCK | |
| Gravity API | 19.3 |
| Ramsbottom carbon, wt % | 6.9 |
| Nitrogen, ppm | |
| Total | 1,700 |
| Basic | 460 |
| Metals wt ppm | |
| N | 11 |
| V | 68 |
| Fe | 1 |
| Na | 2 |
| Metals on catalyst, ppm | 10,800 |
| Nickel + vanadium | |
| PRODUCT YIELDS | |
| Dry gas, wt % | 4.0 |
| Propane/propylene, vol. % | 11.4 |
| Butanes/butylene, vol. % | 15.1 |
| C + gasoline, vol. % | 48.3 |
| Light cycle oil, vol. % | 11.0 |
| Heavy cycle oil and slurry, vol. % | 13.5 |
| coke, wt % | 14.6 |
| Conversion, vol. % | 75.5 |
| Gasoline selectivity, % | 64.0 |
| Gasoline octanes-$C_5$+ | |
| Research clear | 93.2 |
| Motor clear | 80.9 |
| % Coke on regen. cat., wt % | 0.01 |

Referring to the drawing, the hot reduced crude oil charge is passed by line 1 to the bottom of riser reactor 2 where it is mixed with fully regenerated fluid cracking catalyst from line 3. Following conversion in the reactor at temperatures of 482° C. (900° F.) to 538° C. (1000° F.) pressures of 10–50 PSIA and a vapor residence time of 0.5 to 10 seconds cracked effluent comprising desired products and unconverted liquid material is separated from the catalyst in catalyst disengaging zone 4. The effluent is passed by line 5 to the main fractionator 6. Spent cracking catalyst contaminated with carbon and metals compounds is passed by line 7 to regeneration zone 8. The catalyst is regenerated by burning with oxygen containing gas from line 9 and the reactivated catalyst is returned to the cracking zone via line 3. As the fluidized catalyst circulates around the RCC cracking unit undergoing repeated phases of cracking and regeneration the metals content (chiefly vanadium and nickel) accumulates to 2000 to 1500 PPM nickel equivalents. This metal loading inactivates the zeolite cracking ingredient and fresh makeup catalyst must be added to maintain activity and selectivity.

In the main fractionator 6 conditions are controlled to recover by line 10 an RCC gasoline and light ends fractions having a bottom cut portion of about 204°-221° C. (about 400°-430° F.) and comprising about 45-55 volume % of the cracking product. The RCC gasoline is olefinic and it has a research octane in the range of 89 to 95.

A bottoms fraction boiling above about 316°-343° C. (about 600°-650° F.) is recovered by line 11 for further processing and recovery.

The LCO (light cycle oil) fraction described previously is passed by line 12 to selective hydrotreating vessel 13. The hydrogen treating unit is unsaturated aromatic hydrocarbons. At least 20-80 wt% of the unsaturated aromatic hydrocarbons add from 4 to 8 hydrogen molecules to the rings to produce a partially saturated bicyclic hydrocarbon fraction. For example naphthalene gains four hydrogens to yield tetrahydronaphthalene, a naphthene-aromatic hydrocarbon.

The hydrotreating or hydrofining process step of the invention is carried out at selected mild conditions designed to achieve partial saturation while avoiding hydrocracking of ring compounds. Preferred operating conditions are as follows:

TABLE 2

| | BROAD RANGE | PREFERRED RANGE |
|---|---|---|
| Temperature °F. | 600-750 | 675-700 |
| Pressure, psia | 600-1500 | 1100-1300 |
| LHSV | 0.5-3.0 | 1.0 to 2.0 |
| $H_2$ Consumption SCF/Bbl Feed | 500-2500 | 1500-2000 |
| $H_2$ circulation rate, Cu. Ft./Bbl | 1000-4000 | 2500-3500 |

Suitable hydrosaturation catalysts comprise Group VI metal compounds and/or Group VII metal compounds on an alumina base which may be stabilized with silica.

Specific examples of suitable metal components of catalysts include molybdenum, nickel and tungsten. Desirable catalyst composites contain 2-8 wt.% NiO, 4-20 wt.% MoO, 2-15% $SiO_2$ and the balance alumina. The catalyst is placed in one or more fixed beds in vessel 13. The bicyclic aromatic hydrocarbon feed from line 12 is mixed with recycle hydrogen from line 14 and fresh hydrogen introduced through line 15 and the reaction mixture passes downwardly over the catalyst beds in reactor vessel 13.

The selectively hydrosaturated effluent passes via line 16 to separator 17. Unreacted hydrogen is recycled by line 14. The fraction recovered from the separator by line 18 is characterized as a naphthene-aromatic fraction.

The naphthene-aromatic fraction is passed to the bottom of the riser 19 of a fluid catalytic cracking unit designated generally by reference numeral 20. The naphthene-aromatic fraction can be mixed with additional hydrocarbons to be cracked added by line 21. When a metals passivator is used in the FCC unit it can be added to the cracking feed by line 22.

In a preferred embodiment all or a portion of the conventional cracking feed in line 21 is hydrofined prior to cracking. The feed is passed by line 29 and line 12 into saturation hydrogenator 13. Alternatively the cracking feed can be hydrofined in a separate conventional cat. feed hydrofiner (not shown).

Cracking unit 20 is operated in the conventional manner. The naphthene-aromatic fraction is cracked in riser line 19 with regenerated fluid cracking catalyst from line 23. Catalyst is separated from cracked effluent in disengaging zone 24 and the catalyst is passed to regenerator 25. Following regeneration the catalyst is recycled via line 23.

Cracked hydrocarbon effluent is passed by line 26 to separation zone 27. The desired aromatic gasoline product fraction is recovered by distillation via line 28. Separation zone 27 is operated in a conventional manner with known devices and equipment—not shown—to recover various products and recycle streams.

Suitable fluid catalytic cracking conditions include a temperature ranging from about 427° C. to about 704° C. (about 800° to about 1300° F.) a pressure ranging from about 10 to about 50 PSIG, and a contact time of less than 0.5 seconds. Preferred FCC conditions include a temperature in the range of 950°-1010° F. and a pressure of 15-30 PSIA.

Preferred fluid cracking catalysts include activated clays, silica alumina, silica zirconia, etc., but natural and synthetic zeolite types comprising molecular sieves in a matrix having an average particle size ranging from about 40 to 100 microns are preferred. Equilibrium catalyst will contain from 1000 to 3000 nickel equivalents.

The aromatic gasoline fraction cut recovered by line 28 comprises unsubstituted monoaromatics such as benzene, toluene and xylene but the fraction is characterized by a major proportion of alkyl aromatics having one to four saturated side chains. The side chains have from one to four carbon atoms in the chain. The fraction contains 35-55 vol. % monoaromatics with an average octane above 91.

In a preferred embodiment the gasoline fraction from line 28 is combined with the gasoline fraction from line 10. Blending of these fractions provides an overall process gasoline recovery of 60 to 70 vol. % based on the carbometallic oil feed to the process.

In another preferred embodiment, the cracking step in unit 20 is carried out in the presence of a passivator. When the cracking feed contains metals such as nickel and vanadium, a buildup occurs which not only deactivates the catalyst but catalyses cracking of rings and alkyl groups. Dehydrogenation results in excessive hydrogen make. Accordingly commercially available passivators such as antimony, tin and mixtures of antimony and tin are supplied to the cracking unit and/or the catalyst in the known manner. Suitable passivators are disclosed in the following patents: U.S. Pat. No. 4,255,287; U.S. Pat. No. 4,321,129; and U.S. Pat. No. 4,466,884.

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

Reference to patents made in the specification is intended to result in such patents being expressly incorporated herein by reference including any patents or other literature references cited within such patents.

What is claimed is:

1. A process for the production of high octane gasoline component comprising the sequential steps of:

A. Cracking carbometallic petroleum oil characterized by a Conradson Carbon content of at least 1.0 wt% and a metals content of at least 4 ppm Nickel Equivalents by weight in a riser cracking zone at cracking conditions in the presence of fluid cracking catalyst, B. recovering by distillation a light cycle oil fraction boiling in the range of about 216° C. to about 332° C. (about 430° F. to about 630° F.) and containing from about 10 vol. % to about 60 vol. % dual ring unsaturated aromatic hydrocarbons, C. contacting said fraction in the mixed phase in a saturation hydrogenation zone with a nickel-containing hydrogenation catalyst at selective conditions of temperature, pressure, space velocity and hydrogen circulation rate whereby at least 20–80 wt. % of the unsaturated aromatic hydrocarbons add hydrogen molecules to one of the rings to produce a partially saturated bicyclic hydrocarbon fraction, D. subjecting said partially saturated bicyclic hydrocarbon fraction to fluid catalytic cracking in a riser cracking zone at cracking conditions in the presence of with a zeolite fluid cracking catalyst and a metals passivator and in the absence of added hydrogen whereby rate of dehydrogenation is slowed sufficiently so that one ring of the bicyclic hydrocarbon rings cracks yielding monoaromatic hydrocarbons and, E. recovering from said monoaromatic hydrocarbons a gasoline component product characterized by an average octane of at least 91 and a monoaromatic hydrocarbon content in the range of 35 to 55 vol. %.

2. Process according to claim 1 in which the carbometallic petroleum oil feed to Step A is a reduced crude oil containing at least about 70% by volume of 343° C. (650° F.) plus material said feed being further characterized by a Conradson carbon of at least 1.0 wt.% and a metals content of at least 4 ppm nickel equivalents by weight.

3. Process according to claim 1 in which the cracking conditions in Step A comprise a temperature in the range of about 482° C. to about 538° F. (about 900° F. to about 1000° F.) a pressure in the range of 10–50 psia and a vapor residence time in the riser of 0.5 to 10 seconds.

4. Process according to claim 1 in which the cracking effluent from step A is gasoline.

5. Process according to claim 1 in which the hydrogenation catalyst of step C comprises a support material comprising alumina and a minor proportion of an active component selected from the group consisting of nickel oxide, nickel molybdate and nickel tungstate and mixtures thereof.

6. Process according to claim 1 in which the hydrogenation conditions of step C include a temperature in the range of 600° F. to 750° F., a pressure in the range of 600 to 1500 PSIA, a space velocity in the range of, 0.5 to 3.0 a hydrogen circulation rate of 1000–4000 cu. ft. per bbl.

7. Process according to claim 1 in which the fluid catalytic cracking conditions in step D include a temperature in the range of 950° to 1010° F. and a pressure in the range of 15–30 PSIA.

8. Process according to claim 1 in which the fluid cracking catalyst employed in step D comprises a zeolite supported on matrix and a metals content of 1000 to 3000 PPM nickel equivalents at catalyst equilibrium operating conditions and said catalyst is passivated with said passivator selected from compounds of tin, antimony and mixtures thereof.

9. Process according to claim 1 in which the gasoline fraction from reduced crude cracking from step A is blended with the gasoline component from FCC step E whereby the total gasoline recovery from the process is in the range of 60 to 70 Vol.% based on the carbometallic oil feed to Step 1.

10. A process for the production of high octane gasoline component comprising the sequential steps of:

A. cracking carbo-metallic petroleum feedstock comprising a reduced crude oil containing at least about 70% by volume of 343° C. (650° F.) plus material said feed being further characterized by a Conradson Carbon of at least 1.0 wt% and a metals content of at least 4 ppm Nickel Equivalents by weight in a riser cracking zone at cracking conditions in the presence of fluid cracking catalyst containing 2000 to 15000 ppm Nickel Equivalents;

B. recovering by distillation a light cycle oil fraction boiling in the range of about 216° C. to about 332° C. (about 430° F. to about 630° F.) and containing from about 10 wt% to about 60 vol.% dual ring unsaturated aromatic hydrocarbons, including naphthalenes;

C. contacting said fraction in the mixed phase in a saturation hydrogenation zone with a nickel-containing hydrogenation catalyst at selective hydrogenation conditions of temperature, pressure, space velocity and hydrogen circulation rate whereby at least 20–80 wt% of the unsaturated aromatic hydrocarbons add hydrogen molecules to one of the rings to produce a partially saturated bicyclic hydrocarbon fraction, including naphthene-aromatic hydrocarbons;

D. subjecting said partially saturated bicyclic hydrocarbon fraction to fluid catalytic cracking in a riser cracking zone at short contact time cracking conditions of less than 0.5 seconds in the presence of zeolite fluid cracking catalyst passivated with a material selected from compounds of tin, antimony and mixtures thereof, in the absence of hydrogen whereby rate of dehydrogenation is slowed sufficiently so that one ring of the bicyclic hydrocarbon rings cracks yielding monoaromatic hydrocarbons, including alkyl aromatics having one to four saturated side chains having from one to four carbon atoms in the side chain; and E. recovering from said monoaromatic hydrocarbons a gasoline component product characterized by an average octane of at least 91 and a monoaromatic hydrocarbon content in the range of 35 to 55 vol.%.

* * * * *